United States Patent [19]

Hua

[11] Patent Number: 4,704,532

[45] Date of Patent: Nov. 3, 1987

[54] METHODS AND STRUCTURES TO PRODUCE ELECTROSTATIC QUADRUPOLE FIELDS USING CLOSED BOUNDARIES

[75] Inventor: Zhong-yi Hua, Shanghai, China

[73] Assignee: Fudan University, Shanghai, China

[21] Appl. No.: 839,294

[22] Filed: Mar. 13, 1986

[30] Foreign Application Priority Data

Apr. 1, 1985 [CN] China ..... 85102774

[51] Int. Cl.[4] ..... H01J 49/42

[52] U.S. Cl. ..... 250/292; 250/290; 250/281; 250/396 R

[58] Field of Search ..... 250/292, 290, 281, 282, 250/396 R; 313/402, 403

[56] References Cited

U.S. PATENT DOCUMENTS 3,937,954 2/1976 Fite ..... 250/282

4,126,781 11/1978 Siegel ..... 250/396 R

FOREIGN PATENT DOCUMENTS 58-33660 7/1983 Japan .

OTHER PUBLICATIONS

P. H. Dawson, "Radiofrequency Quadrupole Mass Spectrometers", Advance in Electronics and Electron Physics, 1980, pp. 173–256.

C. Y. Hua, "New Possibilities to Prepare Enriched Isotope Targets", Nuclear Instruments and Methods, 1979, pp. 101–107.

Q. X. Jiang, "Calculation of Multiline and Multileaf Electrode Systems", Vacuum Science and Technology, 1981, pp. 151–162.

*Primary Examiner*—Carolyn E. Fields

*Assistant Examiner*—Jack I. Berman

*Attorney, Agent, or Firm*—Pennie & Edmonds

[57] ABSTRACT

The invention includes a method for obtaining an exact electrostatic quadrupole field by the use of simple structures having high resistance materials of uniform or continuously varied thickness to form closed boundaries. The potential of these boundaries is continuously varied with respect to position in accordance with specified design criteria. The method and structures can be used in electron optical systems and related scientific instruments.

6 Claims, 9 Drawing Figures

METHODS AND STRUCTURES TO PRODUCE ELECTROSTATIC QUADRUPOLE FIELDS USING CLOSED BOUNDARIES

TECHNICAL FIELD

This invention relates to the design and construction of electrode structures which develop electrostatic quadrupole fields.

Such structures are useful in electron optics and other instruments for scientific analysis.

BACKGROUND INFORMATION

Until recently, most commercially available electrostatic quadrupole systems were constructed using metallic electrodes with circular cross-sections. Such structures were complicated to machine and the exact quadrupole field existed only in a small region in the vicinity of the center of symmetry of the structure. Moreover, since gaps existed between the electrodes, the resulting electric field was easily influenced by charges randomly accumulated on the inner surface of the enclosure for the electrode structure.

The primary desirable characteristic of an electrostatic quadrupole field (EQF) is that, in such a field, electric intensity varies linearly with the position. In an X-Y plane perpendicular to a Z-axis, the simplest expression of the potential distribution which satisfies this condition is $$V(x,y)=E_o(x^2-y^2) \tag{1}$$

where $E_o$ is a position independent factor which can be time dependent.

In such a field, the equipotential lines are sets of rectangular hyperbolae in the X-Y plane with a four-fold symmetry about the Z-axis. Therefore, an ideal quadrupole field would be generated by a set of four hyperbolically shaped metal rods with adjacent electrodes oppositely charged. Such a structure has been described by P. H. Dawson in "Advances in Electronics and Electron Physics" Supplement 13B, p. 173, Academic Press, 1980.

However, in actual practice, hyperbolic shapes are difficult to machine precisely and to align properly with their respective electrodes. Therefore, most commercial quadrupole systems are made using metallic rods of circular cross-sections. Such systems are used as an approximate substitute for the hyperbolic shapes. This so-called "four rods" EQF system has been described by D. R. Denison in Journal of Vacuum Science and Technology 8, 266, 1971.

Although both the hyperbolic and four rod structures have been widely used in the prior art, each structure has serious disadvantages. Since the hyperbolic or circular rods are both convex, the space which they occupy is much greater than the working space. In particular, with respect to the four circular rod structure, only a quasi-hyperbolic field and not an "exact" EQF can be produced. Therefore, the field is effective only in a limited region near the center of symmetry. Thus, only when x and y are small, does the potential distribution in such a system approximately satisfy the relationship set forth in Eq. (1). The field will deviate substantially from Eq. (1) as x or y increase. If a circular tube is used as an enclosure for such an electrode structure, the ratio of working area radius to tube radius is usually less than 1:4. Moreover, as the electrodes are separated by substantial gaps, any resulting electric field will be influenced by charges randomly accumulated on the inner surface of the enclosure for the electrodes, which is usually made of glass or ceramics.

SUMMARY OF THE INVENTION

The present invention, derived from a calculation for some special electrode structures, is directed to a method for designing structures, and the electrode structures themselves, which produce exact EQF's. Several specific electrode structures are also disclosed. In these structures, materials of high resistivity are used to construct a closed boundary for the electrostatic field. Under the proper conditions, the potential along this boundary will continuously vary with respect to geometric position. An exact EQF is, thus, obtained.

The advantages of the present invention, as compared to conventional structure, are as follows:

1. Any point in the space within the closed boundary of an electrode structure made in accordance with this invention will satisfy the fundamental conditions of an EQF. Therefore, the entire space can be used as the working area. This working space is much larger than those obtained by conventional hyperbolic or circular rod structures.

2. The configuration of the boundary is relatively easy to manufacture.

3. The electric field in the boundary will not be affected by random charges on the inner surface of the enclosure.

The principles by which electrode structures of this invention are designed can be briefly described as follows:

Eq. (1) can be rewritten in polar coordinates as follows:

$$V(r,\theta)=E_o r^2 \cos 2\theta \tag{2}$$

An electrostatic field without space charge will satisfy the following Laplace equation:

$$\nabla^2 V=0 \tag{3}$$

The substitution of Eq. (2) into (3) provides the following general solution:

$$V(r,\theta) = A_o/2 + \sum_{n=1}^{\infty} (A_n \cos n\theta + B_n \sin n\theta) r^n \tag{4}$$

where $A_o$, $A_n$ and $B_n$ are coefficients.

Therefore, an electrode structure with a boundary potential which satisfies the conditions set forth in Eq. (4) will provide an exact EQF.

Following the design principles defined by Eq. (4), an EQF can be generated by a closed boundary made of a material with a specific resistivity upon which the proper potential can be applied. The surface potential of such a structure will vary continuously with position according to the relationship set forth in Eq. (4). Thus, there will be an "exact" EQF within the enclosed boundary.

BRIEF DESCRIPTION OF THE DRAWINGS

The advantages of the present invention will be apparent from the following description of specific embodiments of the invention. These preferred embodiments are described with reference to the following figures.

DESCRIPTION OF THE PREFERRED EMBODIMENTS

Using the design principles set forth in Eq. (4), the circular, square and rectangular quadrupole sructures to generate an exact EQF can be derived as follows:

EXACT EQF WITH CIRCULAR BOUNDARY

To design an electrode structure with a circular boundary of radius R, one assumes that the potential on the boundary surface will vary continuously according to the expression cos $2\theta$. Therefore, all the coefficients in eq. (4) are zero except $A_2=E_o/R^2$. Therefore, $$V(r,\theta)=E_o(r/R)^2\cos 2\theta \tag{5}$$

In fact, this is the solution set forth in Eq. (2). Design criteria for an exact EQF are set forth in FIG. 1, based on the assumption that for a space enclosed by a circular boundary, if the potential 3 at the boundary 1 is varied continuously with position according to the relation cos $2\theta$, the region 2 enclosed by this boundary is an exact EQF.

EXACT EQF WITH SQUARE BOUNDARY

Figure 1:
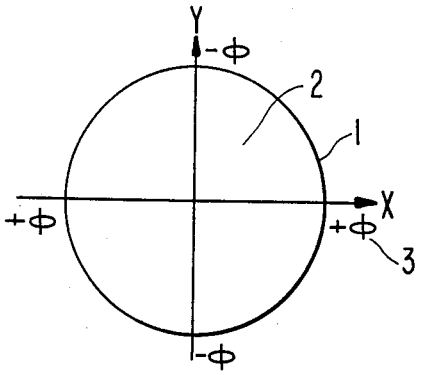
FIG. 1 is a schematic diagram of an exact EQF with circular boundary.
Figure 2:
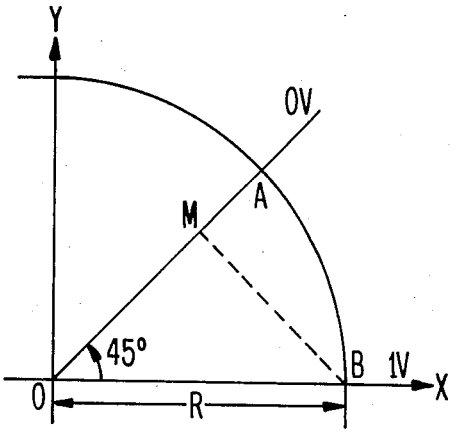
FIG. 2 is a schematic diagram of an exact EQF with square boundary.

A square area may be formed in the circular structure shown in FIG. 1. FIG. 2 shows only $\frac{1}{8}$ of such a structure because of its symmetrical characteristic in the X-Y plane. As shown in FIG. 2, line BM is perpendicular to line OA. Thus, Eq. (5) can be written in Cartesian coordinates as $$V(x,y)=E_o(x^2-y^2)/R^2 \tag{6}$$

Further derivation demonstrates that on the boundary OM ($0\leqq X\leqq R/2$, $y=x$)

$$V=0 \tag{7}$$

on the boundary MB ($R/2\leqq X\leqq R$, $y=R-X$)

$$V=E_o(2x/R-1) \tag{8}$$

Eq. (8) demonstrates that on the boundary MB, electric potential varies linearly with x. Thus, for an enclosed space with square cross-section, if the potential on every flat inner surface is varied linearly with position respectively, then this enclosed space is an exact EQF.

EXACT EQF WITH RECTANGULAR BOUNDARY

Figure 3:
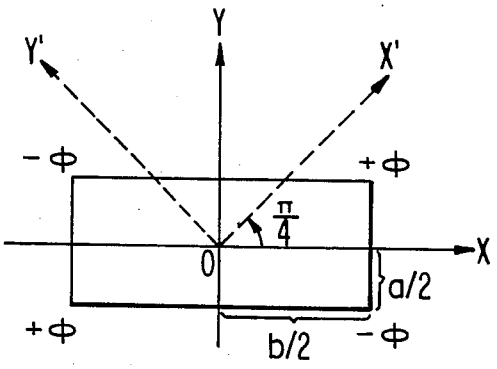
FIG. 3 is a schematic diagram of an exact EQF with rectangular boundary.

As shown in FIG. 3, in the X-Y coordinate system, $$\nabla^2 V(x,y)=0 \tag{9}$$

If the potentials varied with position for every flat edge are $$\begin{cases} V|_{x=b/2}=2\phi y/a;\ V|_{x=-b/2}=-2\phi y/a & \text{(10a)} \\ V|_{y=a/2}=2\phi x/b;\ V|_{y=-a/2}=-2\phi x/b & \text{(10b)} \end{cases}$$

The unique solution for Eqs. (9) and (10) is $$V(x,y)=4\phi xy/ab \tag{11}$$

If the coordinates are rotated by an angle $\pi/4$, then in the new $X'-Y'$ coordinate system (FIG. 3), $$V(x',y')=C(x'^2-y'^2) \tag{12}$$

where C is an arbitrary constant. Since $$x=x'\cos(\pi/4)+y'\sin(\pi/4)$$

$$y=-x'\sin(\pi/4)+y'\cos(\pi/4) \tag{13}$$

From Eqs. (11) and (12), the following solution is obtained $$C=2\phi/ab \tag{14}$$

Therefore, $$V(x',y')=2\phi(x'^2-y'^2)/ab \tag{15}$$

which satisfies the fundamental relation of an exact EQF set forth in Eq. (1), yet the equipotential lines are not sets of orthogonal hyperbolae.

Structures incorporating the above mentioned design principles for generating exact EQFs must have boundaries with continuously varied potential. Metallic electrode surfaces are not useful to produce such structures and special design with chosen materials is required.

Figure 4:
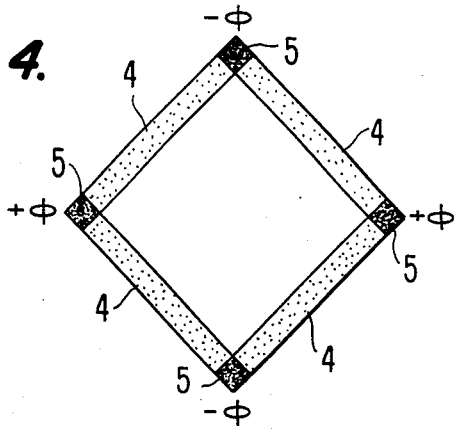
FIG. 4 is the cross-section of an electrode structure with square boundary to generate an exact EQF.
Figure 5:
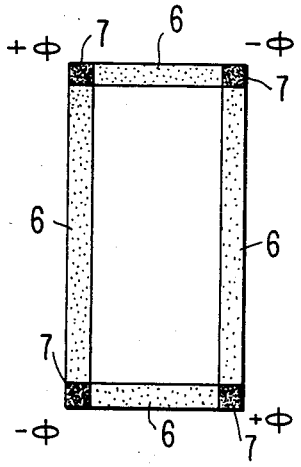
FIG. 5 is the cross-section of an electrode structure with rectangular boundary to generate an exact EQF.

The boundaries with continuously varied potentials is of a potentiometer mode. For the linearly varied potential, as required in square or rectangular boundaries, two methods can be used. First, high resistance materials, e.g. cermet with a resistivity of $10^5$–$10^6$ ohm-cm, are used to form the boundary 4 in FIG. 4 or boundary 6 in FIG. 5 or alternatively, insulating substrates can be used as 4 in FIG. 4 or 6 in FIG. 5, on which a uniform high resistance film, e.g. Cr-SiO or C, is deposited. If potentials $+\phi$, $-\phi$, $+\phi$, $-\phi$ are applied to the electrodes 5, an exact EQF will be generated by the structures shown in FIGS. 4 and 5.

A circular boundary with its potential varying continuously in accordance with cos $2\theta$ requires a somewhat different structure. The shapes of a high resistance material prepared for generating the required surface potential are shown in cross-section in FIG. 6.

This figure is also shown only as $\frac{1}{8}$ portion of the total boundary area because of the four-fold symmetry of the device. The inner wall AB is a circle with normalized radius $r=R=1$. The outer boundary surfce CD is a curve with function $f_1$ (r,0). The proposed condition for this structure is that when the potential is one volt on $\theta=0$ (surface BC) and zero on $\theta=\pi/4$ (surfce AD), the potential on the inner surface BA must vary according to the relation, cos $2\theta$.

If U (r,$\theta$) is the potential of any point in the region ABCD and the Laplace equation set forth below is also satisfied, i.e.

$$\nabla^2 U=0 \tag{11}$$

when the boundary conditions are at r=1, then $$\begin{cases} U(1,\theta) = \cos 2\theta & (12) \\ \partial U(1,\theta)/\partial_n = 0 & (13) \end{cases}$$

and the unique solution of Eq. (11) is $$U=(r^2+r^{-2})\cos 2\theta/2 \tag{14}$$

On curve $f_1$ (r,$\theta$), the normal derivative $\partial U/_{\partial n}$ must also be equal to zero, i.e.

$$U_r+U_\theta(-r^{-2}dr/_{d\theta})=0 \text{ at } r>1 \tag{15}$$

From Eqs. (14) and (15), the following solution is derived $$\sin 2\theta=kr^2/(r^4-1) \tag{16}$$

where k is a constant which can be determined by the r value at $\theta=\pi/4$. If $r=\alpha>1$ at $\theta=\pi/4$, then $$k=(\alpha^4-1)/\alpha^2$$

and Eq. (16) becomes $$\sin 2\theta=|r^2(\alpha^4-1)/\alpha^2(T^4-1)$$

Eq. (17) is the form of curve $f_1$ (r,$\theta$) on FIG. 6. The shape of this curve is roughly shown by the dotted line DC in FIG. 6.

However, the conditions of $f_1$(r,$\theta$) at $\theta=0$ cannot be fulfilled, since it is known from Eq. (17) that, at $\theta$ 0, r($\theta$)$\rightarrow\infty$. Thus, at $\theta=0$, the potential on the line BC where r>1 must vary as $$U=(r^2+r^{-2})/2 \tag{18}$$

according to Eq. (14). Therefore, point B ($\theta=0$, r=1) may be used as one of the terminals to find an equipotential line $f_2$ (r,$\theta$) on which U=1 volt. From Eq. (14), the curve $f_2$ (r,$\theta$) may be expressed as $$l=(r^2+r^{-2})\cos 2\theta/2$$

or $$r^2=sec\ 2\theta+tg\ 2\theta \tag{19}$$

Figure 6:
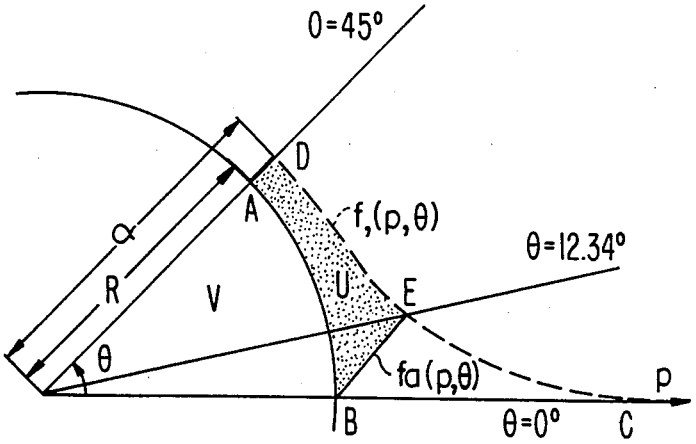
FIG. 6 is a partial view of the boundaries of an electrode structure to generate an exact EQF, the inner surface of which is a circular tube and the outer surface of which satisfies a defined function.
Figure 7:
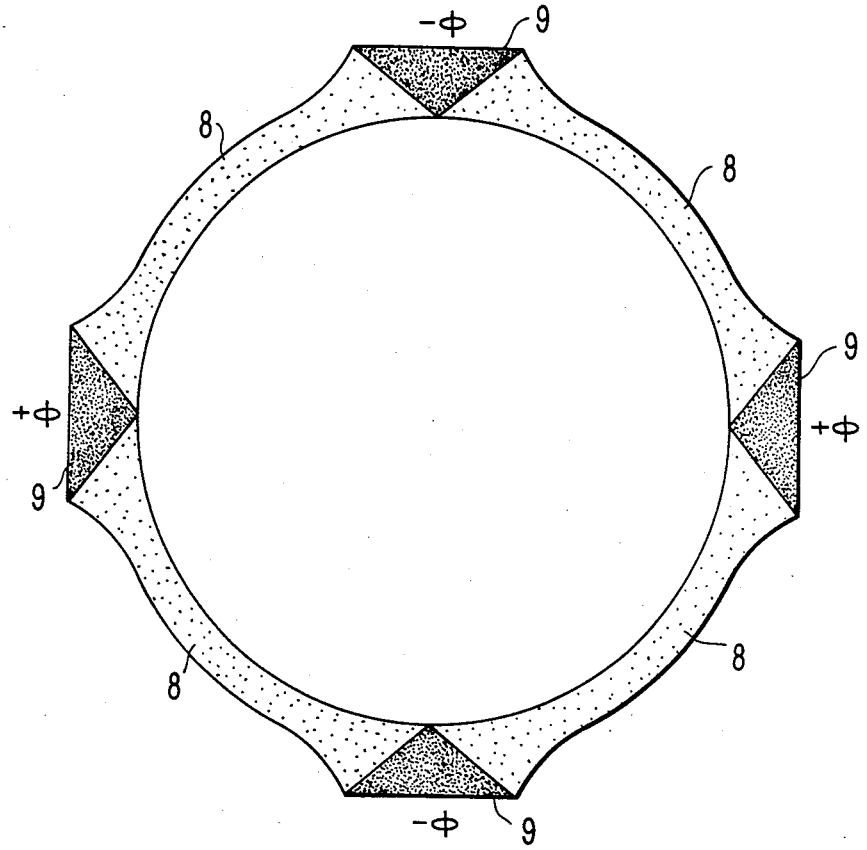
FIG. 7 is the cross-section of an electrode structure, such as shown in FIG. 6, with circular inner surface.

Therefore, the cross-section of the high resistance material can be determined as the shaded area ABED in FIG. 6 where E is the intersecting point of $f_1$ (r,$\theta$) and $f_2$ (r,$\theta$) and the shape of BE is determined by Eq. (19). Finally, the shape of the boundary material is determined as shown in FIG. 7 with a four-fold symmetry. The shaded portion 8 is a suitable high resistance material such as a synthetic mica with a resistivity $10^5$–$10^6$ ohm-cm which is easily machinable and operates well in a vacuum. The outer edge of this material should satisfy Eq. (17). The black regions 9 in FIG. 7 are metallic electrodes. The interface between the electrodes 9 and the high resistivity material 8 should satisfy Eq. (19). Applying potentials $+\phi$, $-\phi$, $+\phi$, $-\phi$ to the electrodes 9 generates continuously varied potentials according to cos $2\theta$ on the inner circular surface. The space enclosed by this surface will be an exact EQF.

This present invention may also be used in two alternative structures, a square monopole and a quadrupole mass analyzer array.

THE SQUARE MONOPOLE

Figure 8:
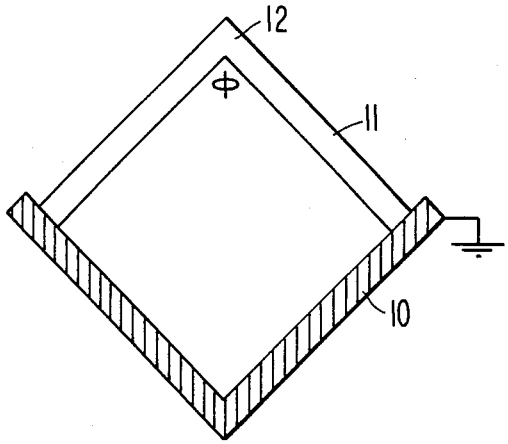
FIG. 8 is a monopole structure with square boundary.

As shown in FIG. 8, an L-shaped insulator 11 coated with a thin film of high resistance material is placed on an L-shaped metallic plate 10. The ends of the film are connected to the metal. At the corner 12, a potential $\phi$ is applied and the metallic plate is grounded, as shown in FIG. 8. By electrostatic imaging, this structure is equivalent to a quadrupole with square boundary. The primary advantage of this structure is its extreme simplicity.

THE QUADRUPOLE MASS ANALYZER ARRAY

Figure 9:
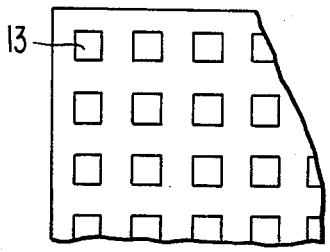
FIG. 9 is a schematic diagram for a quadrupole mass analyzer array.

As shown in FIG. 9, an array of holes 13 of square outline are deposited on a substrate made of high resistance alumina ceramics or microcrystalline glasses. The holes are deposited as a thin film of uniform thickness and high resistivity. When suitable potentials are applied, every hole represents a square EQF. The configuration shown in FIG. 9 is one embodiment of such a structure. This structure may be used in angle-resolved ion spectrometers.

This invention can be used in mass spectrometers, secondary ion mass spectrometers, electron gun and deflection systems, for broad-band cathode-ray tubes, anastigmatic lens in electron optical systems, the focusing of high-energy particles and the preparation of enriched isotope targets for nuclear reaction experiments.

I claim:

1. A method for producing an electrostatic quadrupole field comprising the step of forming a grouping of electrodes in a closed boundary structure having an inner surface formed of high resistance material, and the step of generating an electrostatic quadrupole field within said closed boundary structure by applying an electric potential to said structure which is continuously varied with position.

2. An electrode structure for producing an electrostatic quadrupole field comprising boundary structure having an inner surface of the cross-section forming the boundary of said electrode structure of circular outline and high resistance material, the hickness of said boundary material being continuously varied, the outer surface of said boundary material having four-fold symmetry, so that the potential on said circular inner surface of said boundary varies continuously with position according to the relation cos $2\theta$.

3. An electrode structure for producing an electrostatic quadrupole field comprising boundary structure having an inner surface of the cross-section forming the boundary of said electrode structure of square outline and high resistance material, said boundary material being of uniform thickness so that the potential on the inner surface of said square boundary varies lineraly with position.

4. The electrode structure as claimed in claim 3, wherein the electrode structure is an array of multiple square-boundary structures so that potential on the edges of said square-boundary structures varies linearly with position.

5. An electrode structure for producing an electrostatic quadrupole field comprising boundary structure having an inner surface of the cross-section forming the boundary of said electrode structure of rectangular outline and high resistance material, said boundary material being of uniform thickness so that the potential on the inner surface of said rectangular boundary varies lineraly with position so that, in the X-Y plane perpendicular to the Z-axis, the equipotential lines generated by said electrode structure are sets of non-orthogonal hyperbolae.

6. An electrode structure for producing an electrostatic quadrupole field comprising boundary structure having an inner surface of the cross-section forming the boundary of said electrode structure of square outline, said inner surface forming the boundary comprising an L-shaped metallic plate affixed to an L-shaped insulator, said L-shaped insulator coated with a film of high-resistivity material, said film being a thin film with uniform thickness, and a single electrode connected to said boundary structure, said electrode being located on the central corner of said L-shaped insulator coated with said high-resistivity material.

* * * * *